US008516996B2

(12) United States Patent
Solferino et al.

(10) Patent No.: US 8,516,996 B2
(45) Date of Patent: Aug. 27, 2013

(54) DIRECT FUEL INJECTION SYSTEM FOR INTERNAL COMBUSTION ENGINE WITH CONICAL RING INJECTOR ISOLATOR

(75) Inventors: Vince Paul Solferino, Dearborn, MI (US); Paul Zeng, Inkster, MI (US); Scott Lehto, Dearborn, MI (US); Patrick Brostrom, Livonia, MI (US); Giuseppe DeRose, Jr., Canton, MI (US); Simon Antonov, West Bloomfield, MI (US); Jim Chern, Troy, MI (US)

(73) Assignee: Ford Global Technologies, Dearborn, MI (US)

( * ) Notice: Subject to any disclaimer, the term of this patent is extended or adjusted under 35 U.S.C. 154(b) by 530 days.

(21) Appl. No.: 12/957,728

(22) Filed: Dec. 1, 2010

(65) Prior Publication Data

US 2012/0138013 A1 Jun. 7, 2012

(51) Int. Cl.
*F02M 61/14* (2006.01)

(52) U.S. Cl.
USPC ..... 123/470; 277/594

(58) Field of Classification Search
USPC ..... 123/470; 277/591, 594, 595
See application file for complete search history.

(56) References Cited

U.S. PATENT DOCUMENTS

| | | | | |
|---|---|---|---|---|
| 5,538,262 | A | 7/1996 | Matsumura | |
| 7,383,818 | B1 | 6/2008 | Beardmore | |
| 7,422,193 | B2 | 9/2008 | Sisk et al. | |
| 7,640,917 | B2 | 1/2010 | Daniel et al. | |
| 7,665,198 | B2 | 2/2010 | Cho et al. | |
| 7,823,565 | B2 * | 11/2010 | Chern et al. | 123/470 |
| 7,827,964 | B2 * | 11/2010 | Chern et al. | 123/470 |
| 8,151,760 | B2 * | 4/2012 | Hoefner | 123/294 |
| 8,469,004 | B2 * | 6/2013 | Solferino et al. | 123/470 |
| 2005/0016501 | A1 * | 1/2005 | Krause et al. | 123/470 |
| 2007/0175451 | A1 | 8/2007 | Beardmore | |
| 2009/0071445 | A1 | 3/2009 | Mueller et al. | |
| 2009/0235898 | A1 * | 9/2009 | Short | 123/470 |
| 2010/0006060 | A1 | 1/2010 | Hoefner | |
| 2011/0000464 | A1 * | 1/2011 | Kannan et al. | 123/470 |
| 2011/0094478 | A1 * | 4/2011 | Scheffel et al. | 123/470 |
| 2011/0265767 | A1 * | 11/2011 | Xu et al. | 123/470 |

* cited by examiner

*Primary Examiner* — Thomas Moulis

(74) *Attorney, Agent, or Firm* — Jerome R. Drouillard; Julia Voutyras

(57) ABSTRACT

A fuel injection system for an internal combustion engine includes a fuel injector pocket, formed within a cylinder head, for housing an injector which sprays fuel into a combustion chamber defined by the cylinder head and a piston crown. The injector is mounted with a conical isolator which is loaded at a lower, elastic rate during lower power operation, with the conical isolator being stacked solid between a tapered portion of the injector and a corresponding tapered portion of the cylinder head during high power operation of the engine and injection system. The isolator controls unwanted injector ticking noise, while protecting the integrity of the injector's tip seal by preventing excessive axial displacement of the injector during higher load operation.

20 Claims, 8 Drawing Sheets

DIRECT FUEL INJECTION SYSTEM FOR INTERNAL COMBUSTION ENGINE WITH CONICAL RING INJECTOR ISOLATOR

TECHNICAL FIELD

The present disclosure relates to an internal combustion engine having fuel injectors mounted within a cylinder head and spraying fuel into the engine's combustion chambers.

BACKGROUND

Most spark-ignited internal combustion engines used in automotive vehicles have employed fuel systems with either a carburetor, or more recently, multiple fuel injectors mounted in an intake manifold or within individual intake ports. Each of these systems provides fuel to the engine via the intake manifold. Although manifold/port mounted fuel injectors have generally been satisfactory, and indeed, a great improvement as compared with carburetor systems, automotive designers are increasingly moving to the use of direct fuel injection with spark-ignited engines. With a direct injection system, fuel injectors are typically mounted through the fire deck of the engine's cylinder head and provide fuel directly into each of the engine's combustion chambers.

In spark ignition engines, direct injection has been found to be beneficial in terms of improved fuel economy, coupled with reduced exhaust emissions. Although direct injection has been used in many types of diesel engines for years, this new application of direct injection, particularly in gasoline engines intended for use in automotive vehicles, has created a problem because the higher pressures utilized with direct injection have caused unwanted noise or "tick" while the engine is idling; under certain cases the tick may become more pronounced at high speeds and loads. This tick noise, resulting from injector needle impact, has not generally been a problem with most diesel engines, but has definitely proved to be an issue with direct-injected spark ignited engines used in automobiles, as well as with some diesel engines.

It would be desirable to provide a system allowing a low noise signature for gasoline and diesel direct injection fuel systems at lower loads, including idle, while at the same time preserving the durability of fuel injectors by preventing unwanted injector movement during higher load operation. This presents a challenge, because if, without anything more, the injector's mounting is softened to the point where ticking noise is attenuated at idle, the corresponding axial movement of the injector within the cylinder head's injector pocket at high loads may cause adverse durability affects upon injector tip seals.

SUMMARY

According to an aspect of the present disclosure, a fuel injection system for an internal combustion engine includes a cylinder head having an injector pocket extending through the cylinder head to a combustion chamber, with the pocket having a conical lower wall. A fuel injector is mounted within the injector pocket and extends to the combustion chamber. The injector has a conical mounting surface for engaging the conical lower wall of the injector pocket. An isolator mounted between the conical mounting surface of the injector and the lower wall of the injector pocket includes a conical ring having an outer surface and an inner surface. The isolator is configured so that at lower injection loads, only an upper contact portion of the outer surface of the conical ring contacts said conical lower wall of said injector pocket. Also at lower injection loads, only a lower contact portion of said inner surface of the conical ring contacts the conical mounting surface of the injector. However, at higher injection loads, the portion of the conical ring extending between the ring's upper contact portion and lower contact portion is clamped between the conical mounting surface of the injector and the conical lower wall of the injector pocket.

According to another aspect of this disclosure, the isolator is configured as a conical ring having a single, radially oriented spring rate and an included conic angle which is greater than the included conic angles corresponding to the conicity of said conical mounting surface of said injector and said conical lower wall of said injector pocket.

According to another aspect of the present disclosure, substantially the entire portion of the conical ring extending between the ring's upper contact portion and lower contact portion is clamped solidly between the conical mounting surface of the injector and the conical lower wall of the injector pocket during operation of the injector at higher loads, whereby axial movement of the injector will be restricted at higher injector loads.

According to another aspect of the present disclosure, the isolator reacts elastically to radial loading during operation of the injector at idle and stacks solidly between the conical mounting surface of the injector and the conical lower wall of the injector pocket at higher injection loads.

It is an advantage of a fuel injection system according to the present disclosure that objectionable ticking noise which is particularly prevalent in engines having direct cylinder injectors, will be avoided, while at the same time protecting injector tip seals from harm which could otherwise occur as a result of a compliant mounting system.

It is another advantage of a system according to the present disclosure that a single rate load deflection curve is established for an initial elastic response of the injector mount to the forces imposed upon the injector while the injector is operating at lower loads, with the elasticity being supplanted by stacked solid operation at and above moderate injector loads.

It is yet another advantage of a fuel injection system according to the present disclosure that the isolator used in the present system is readily tunable to accommodate changes in engine operating parameters.

Other advantages, as well as features of the present isolator system, will become apparent to the reader of this specification.

DETAILED DESCRIPTION OF THE PREFERRED EMBODIMENTS

Figure 1:
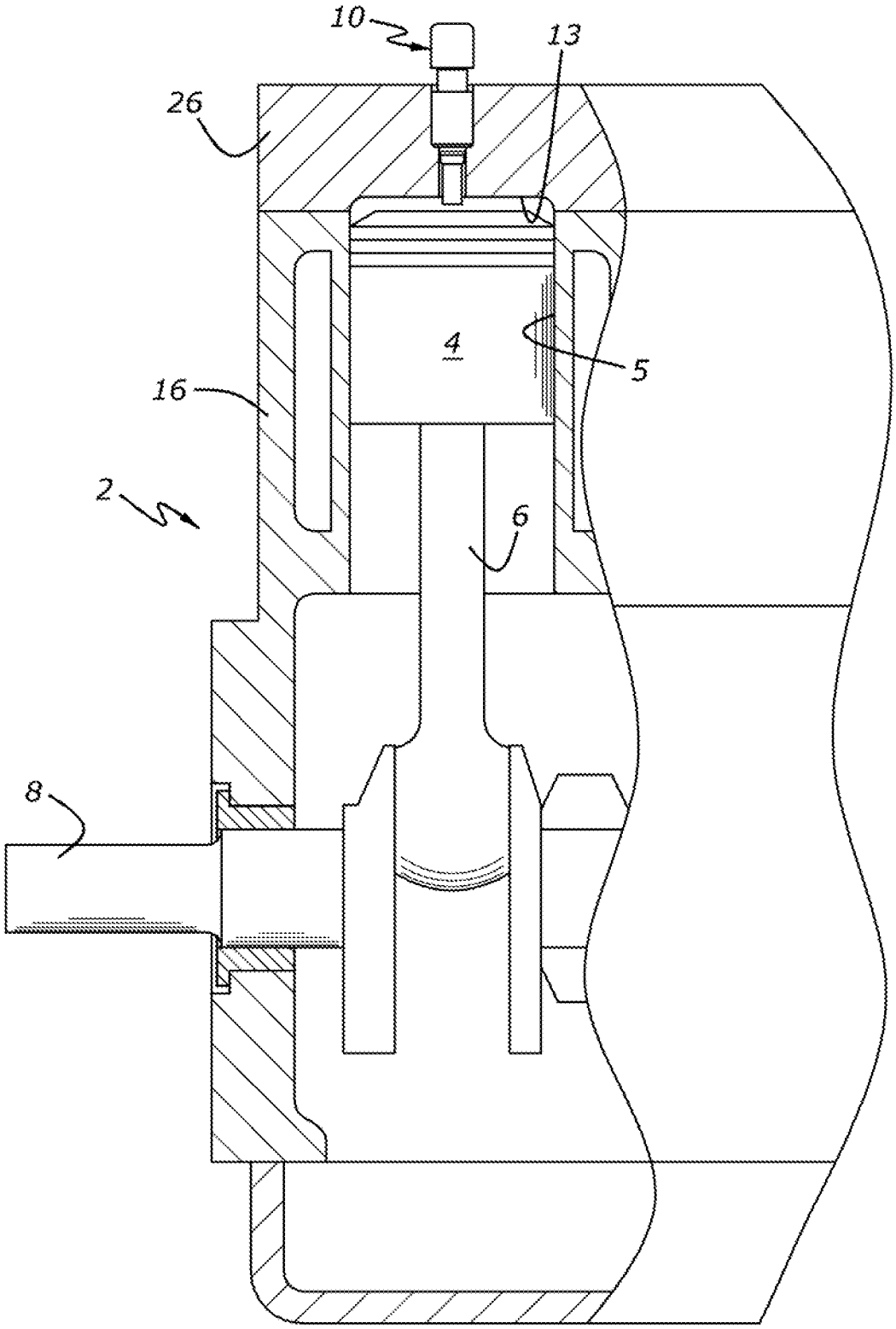
FIG. 1 is a schematic representation of a portion of an engine having a fuel injection system according to the present disclosure.

FIG. 1 illustrates an engine, 2, having a crankshaft, 8, with a piston, 4, and a connecting rod, 6, attached thereto, for reciprocating motion within a cylinder, 5, formed in a cylinder block, 16. A cylinder head, 26, is mounted at the top of engine 2. A fuel injector, 10, is mounted through cylinder head 26 so as to supply fuel directly to a combustion chamber, 13, defined by cylinder head 26 and piston 4.

Figure 2:
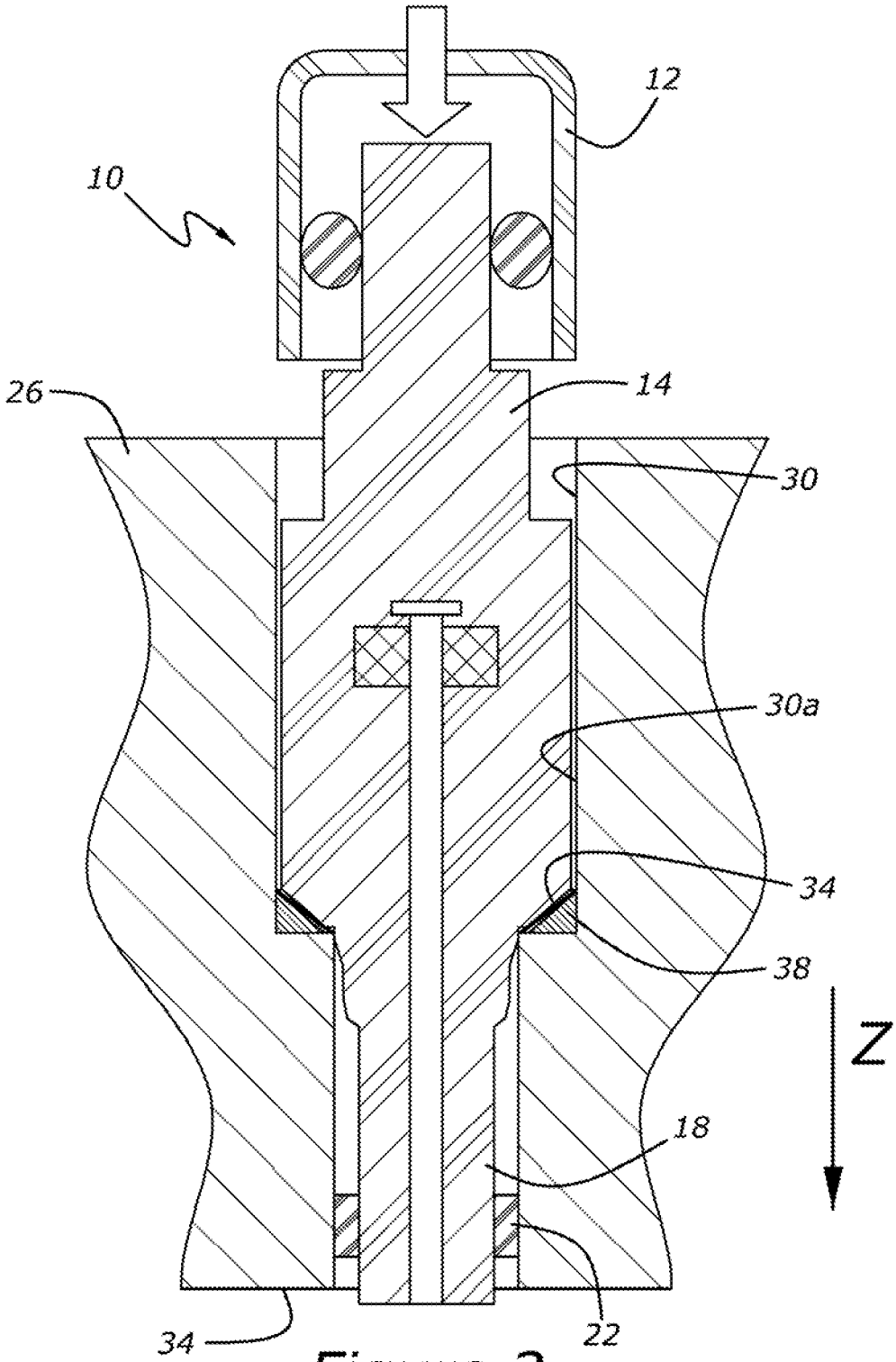
FIG. 2 is a partially schematic representation of an injector mounted in a cylinder head according to an aspect of the present disclosure.

FIG. 2 is a partially schematic representation of a fuel injection system having an injector isolator according to an aspect of the present disclosure. Fuel injector 10 receives fuel through a supply system including a fuel rail cap, 12, which is mounted to the top of injector 10. Injector 10 has a generally cylindrical outer body, 14, which is mounted within an injector pocket, 30, formed in cylinder head, 26. Injector 10 has a tip, 18, with a tip seal, 22, which is preferably formed from a plastics material such as polytetrafluoroethylene. Injector tip 18 extends through fire deck 34 of cylinder head 26. Because fire deck 34 and the upper surface of piston 4 configure combustion chamber 13, injector 10 is deemed to be a direct injector. Tip seal integrity is important because tip seal 22 prevents high pressure gases from leaking from combustion chamber 13 past injector tip 18. Those skilled in the art will appreciate in view of this disclosure that the present injector mounting system could be employed with either top or side feed, or yet other types of injectors.

Figure 3:
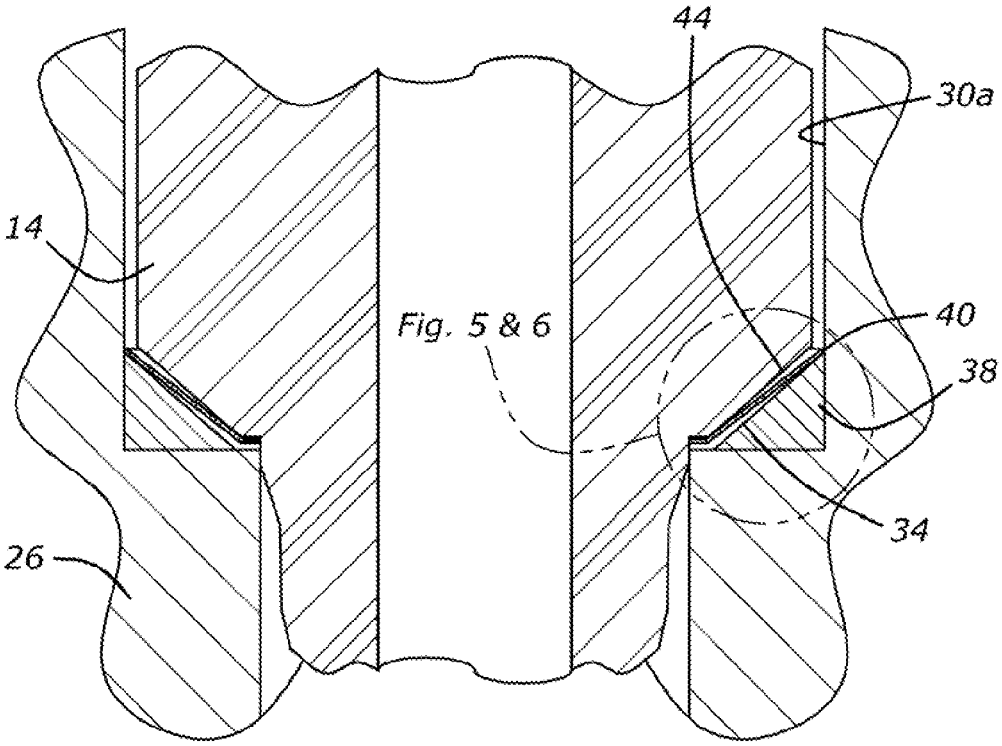
FIG. 3 shows a portion of the injector of FIG. 2, specifically an isolator portion of the injector mounting system.

As shown in FIG. 3, injector pocket 30 has an outer wall, 30*a*, which is generally cylindrical, and a conical lower wall, 34. Injector 10 is mounted within injector pocket 30, including surfaces 30*a* and 34, with an isolator, 40, being mounted between conical mounting surface 44 of injector 10 and conical lower wall 34 of injector pocket 30. Conical lower wall 34 of the injector pocket is incorporated within a base ring, 38, inserted into injector pocket 30.

Figure 4:
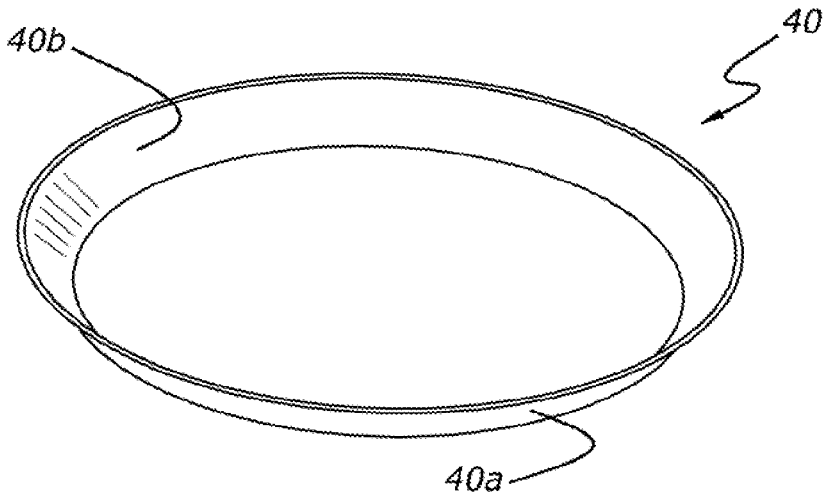
FIG. 4 is a perspective enlargement of a portion of FIG. 3, showing a ring isolator system in greater detail.

FIG. 4 shows ring isolator 40, which is formed as a high-strength, resilient annulus, preferably formed from a metal such as stainless steel. Isolator 40 has an outer surface, 40*a*, and an inner surface, 40*b*. Ring 40 has a single internal radially directed spring rate which enables ring 40 to function as both a resilient or spring mounting system, and a solid shim.

Figure 5:
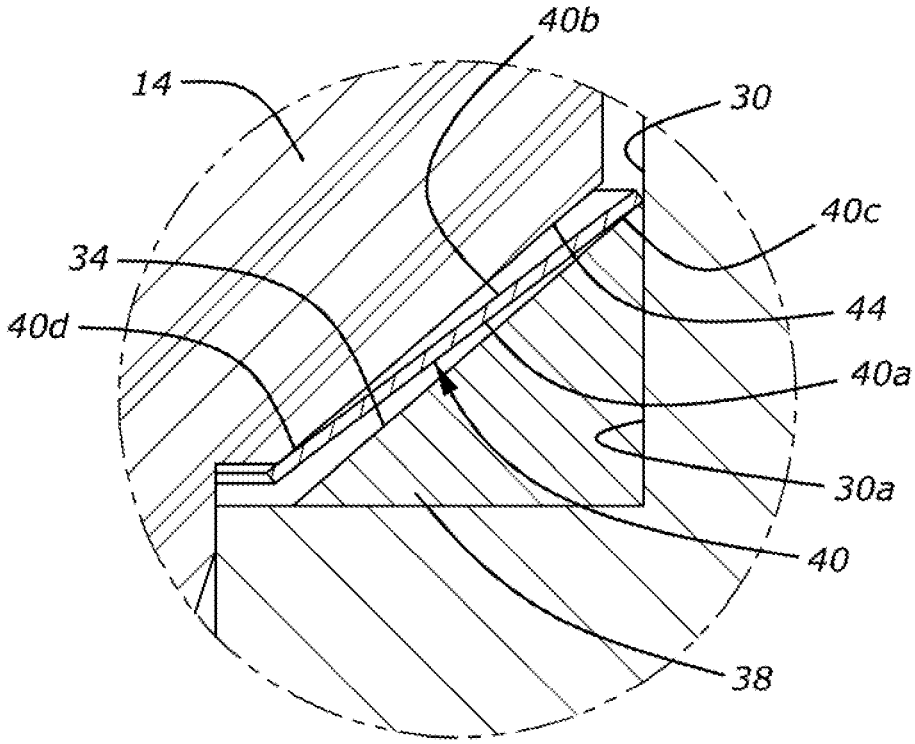
FIG. 5 shows the isolator of FIG. 4 in an elastic state corresponding to lower load operation.
Figure 6:
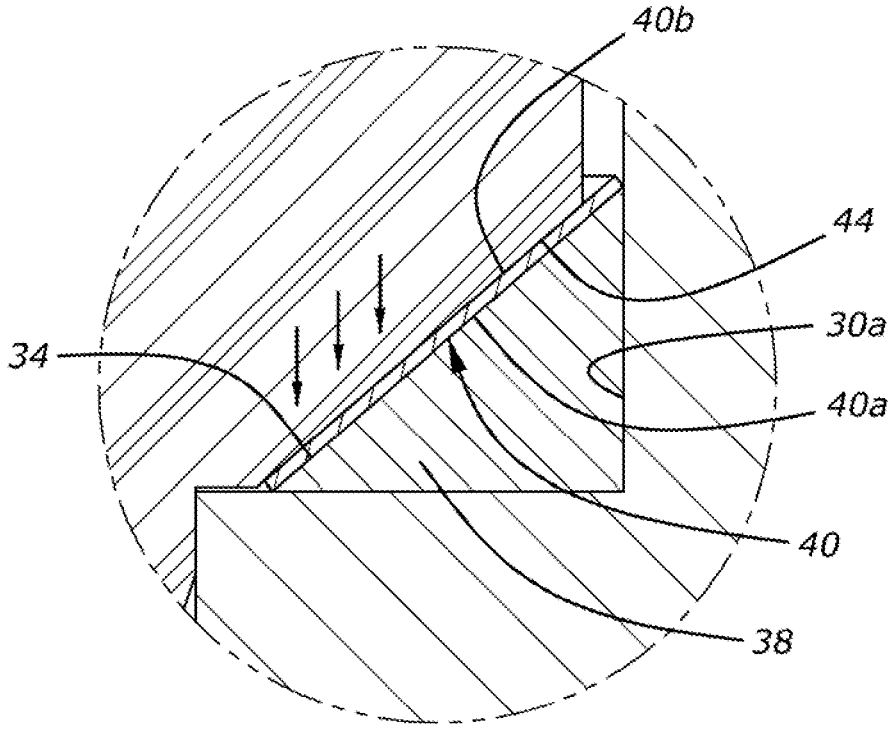
FIG. 6 shows the isolator of FIG. 4 in a compressed state corresponding to higher load operation.
Figure 7:
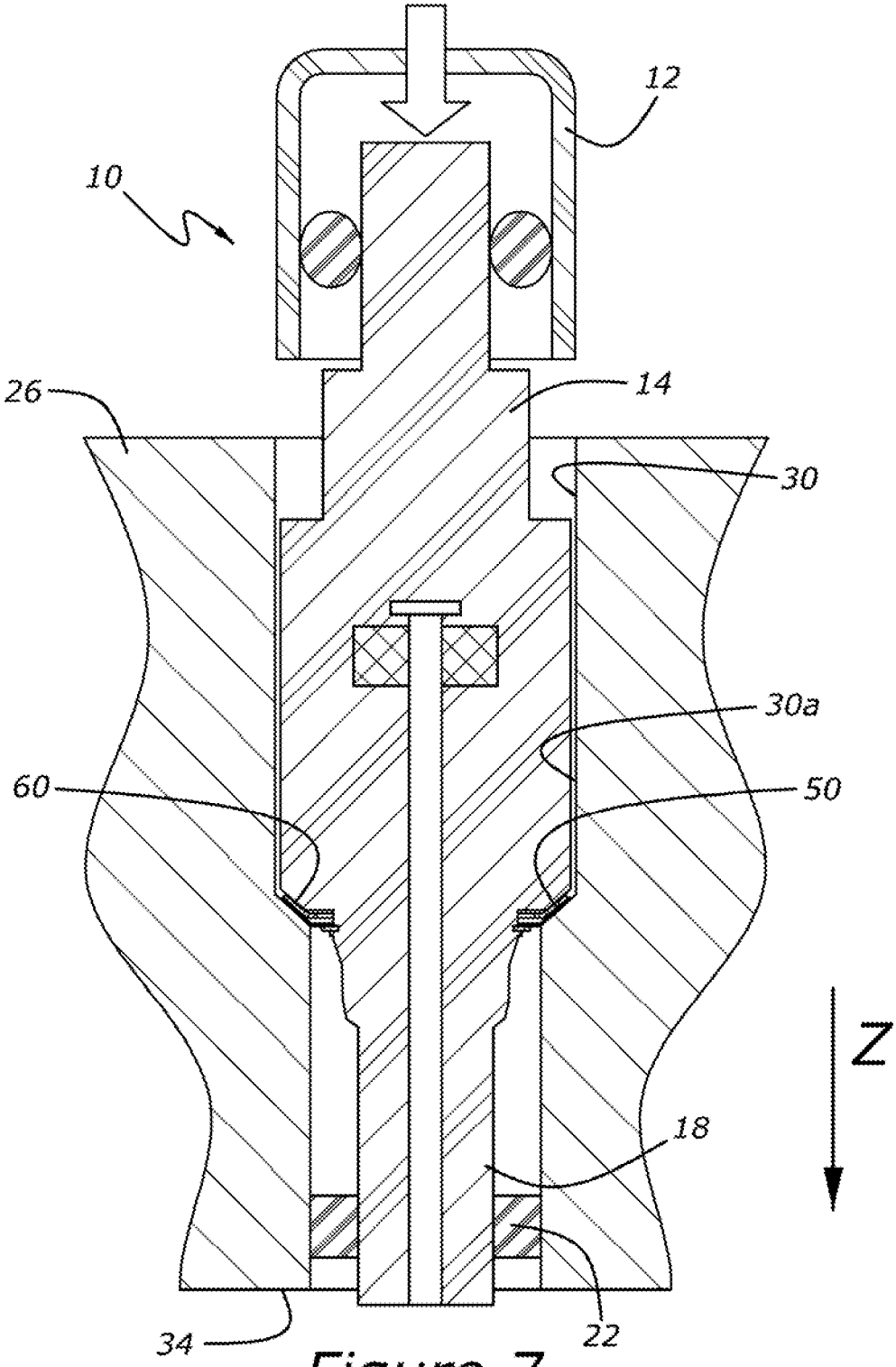
FIG. 7 is a partially schematic representation of an injector mounted in a cylinder with a modified isolator according to another aspect of the present disclosure.

FIGS. 5 and 6 detail the employment of isolator 40. In FIG. 5, which applies to lower load operation, upper contact portion 40*c* of outer surface 40*a* is in contact with conical lower wall 34 of base ring 38. Lower contact portion 40*d*, which is provided on inner surface 40*b*, is in contact with conical mounting surface 44 of injector 10. In essence, when injector 10 is operating at lower loads, such as during idle operation, isolator 40 suspends injector 10 elastically between conical mounting surface 44 and conical lower wall 34. This resilient, or spring, mounting helps to prevent ticking noises which arise within injector 10 from being transmitted to cylinder head 16, thereby reducing objectionable noise. Isolator 40 is able to function as a suspension spring for injector 10 because conical ring 40 has an included conic angle which is greater than the included conic angles corresponding to the conicity of both conical mounting surface 44 of injector 10 and conical lower wall 34 of injector pocket 30.

FIG. 6 illustrates injector 10 during higher load operation in which injector 10 is forced downwardly into injector pocket 30. Downward displacement of injector 10 drives isolator ring 40 outward radially, clamping ring 40, particularly the span between upper contact portion 40*c* and lower contact portion 40*d*, solidly between surfaces 44 and 34. In effect, injector 10 is stacked solid with cylinder head 26. This solid stacking provides a very high measure of resistance to further axial displacement of injector 10, protecting tip seal 22 from damage.

Figure 8:
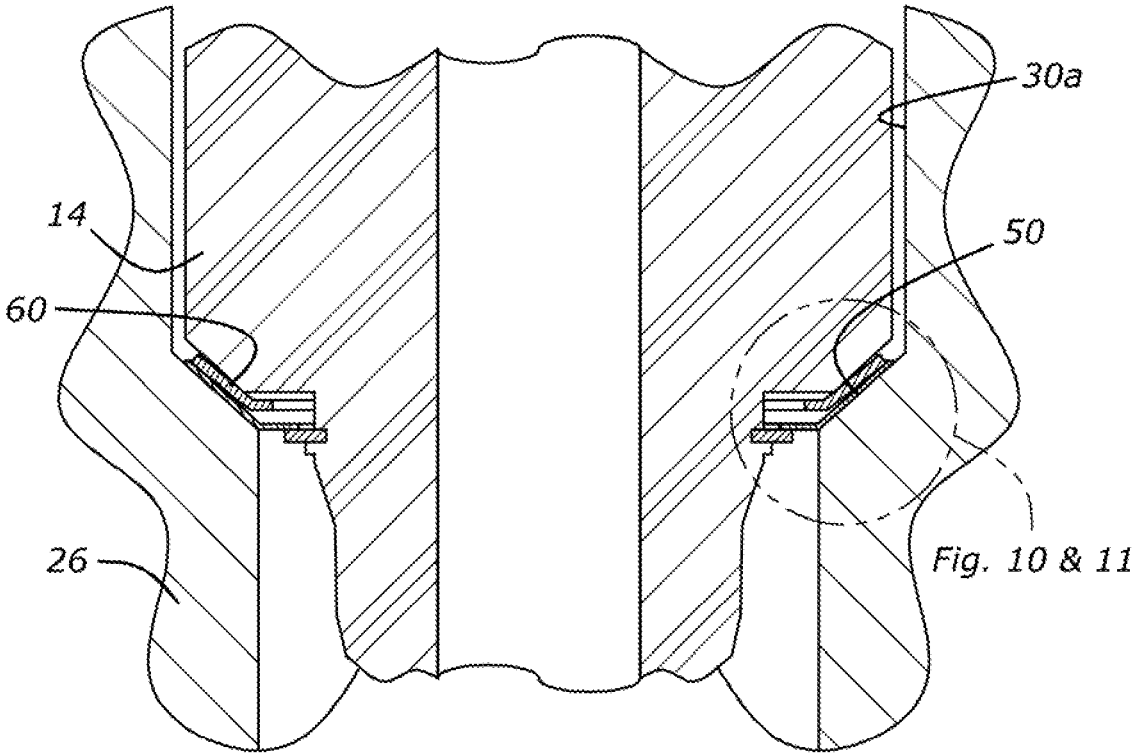
FIG. 8 shows a portion of the injector of FIG. 7, specifically an isolator portion of the injector mounting system.
Figure 9:
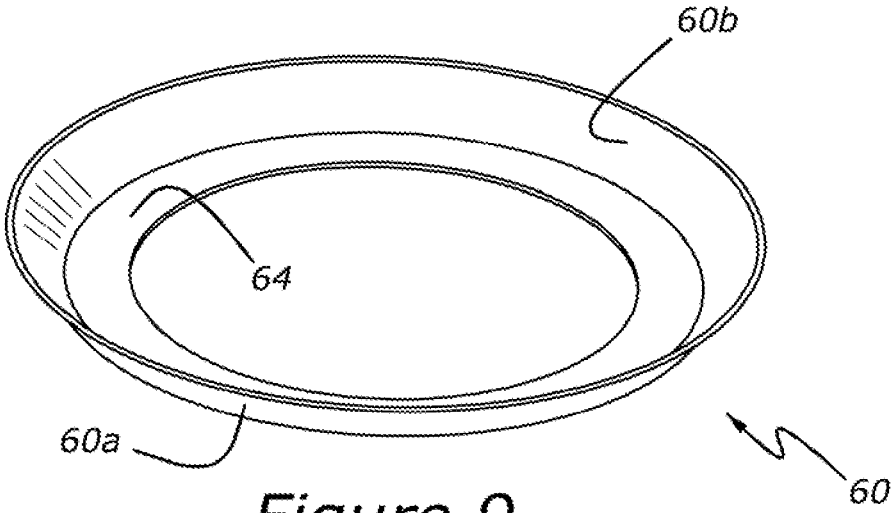
FIG. 9 is a perspective enlargement of a portion of FIG. 8, showing a ring isolator system in greater detail.

FIGS. 7-11 illustrate another embodiment of the present isolator in which, as shown in FIG. 9, a conical upper ring section, 60*a* and 60*b*, is joined with an annular plate, 64 extending from a lower portion of the conical ring, with annular plate 64 and the conical ring being one piece. Annular plate 64, which increases the stiffness of isolator 60, may be employed to tune the operation of isolator 60 to the needs of a particular engine.

Figure 10:
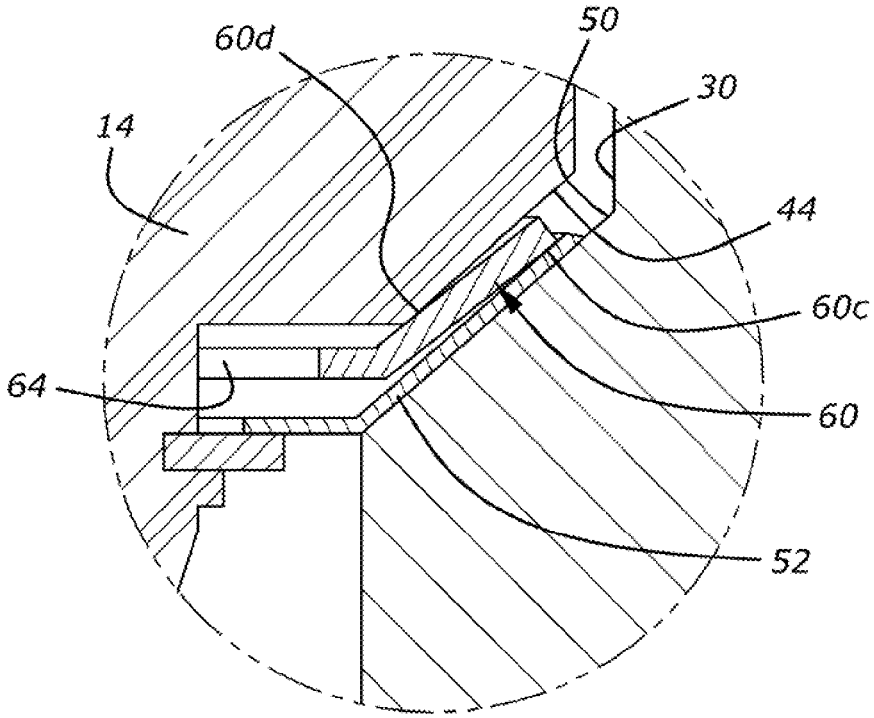
FIG. 10 shows the isolator of FIG. 9 in an elastic state corresponding to lower load operation.
Figure 11:
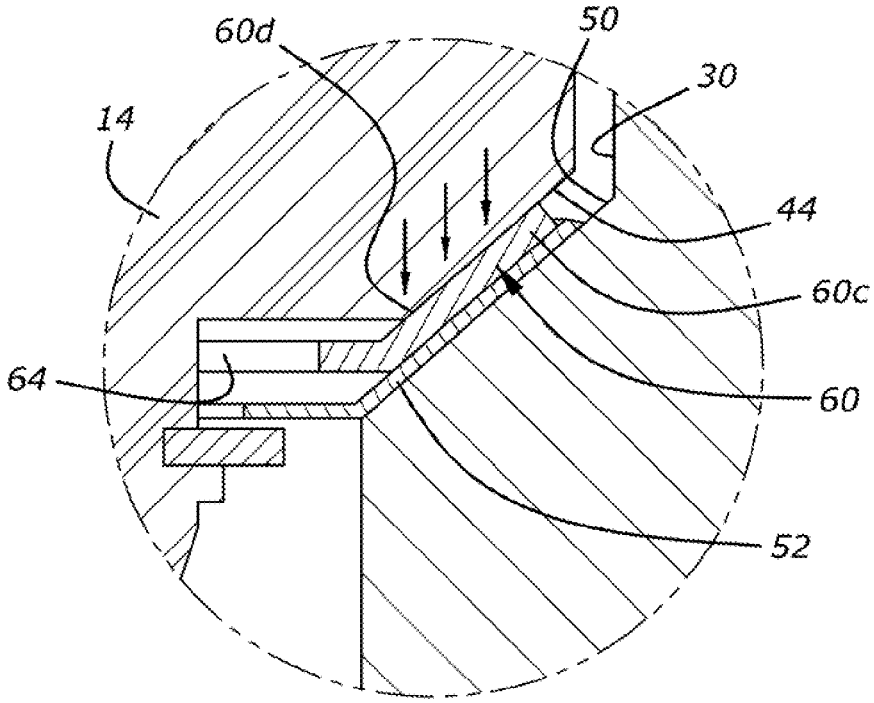
FIG. 11 shows the isolator of FIG. 9 in a compressed state corresponding to higher load operation.

FIGS. 8, 10, and 11 also show conical lower wall 50 as being one-piece with the parent metal of cylinder head 26. Head liner 52, which is preferably formed from a high strength material such as steel, is employed to protect head 26 from the wear effects of isolator 60. Head liner 52, which is not intended to be a resilient element, merely follows the contour of conical lower wall 50. Those skilled in the art will appreciate in view of this disclosure that, depending upon the alloy chosen for cylinder head 26, head liner 52 may not be required. It will further be appreciated that either of the isolators disclosed herein may be employed with an integral, one-piece conical lower wall 50.

As with FIG. 5, FIG. 10 shows the present system during lower load operation in which surfaces 60*c* and 60*d* are in contact with head liner 52, and injector mounting surface 44, respectively. Resilient, elastic flexing of isolator 60 provides a spring suspension for injector 10.

FIG. 11 shows isolator 60 clamped between surface 44 of injector 10 and headliner 52, as supported by conical lower wall 50. As before, the portion of conical ring 60 extending between upper contact portion 60*c* and lower contact portion 60*d* is displaced radially outward by injector 10 and clamped solidly between conical mounting surface 44 and conical lower wall 50 of injector pocket 30.

Figure 12:
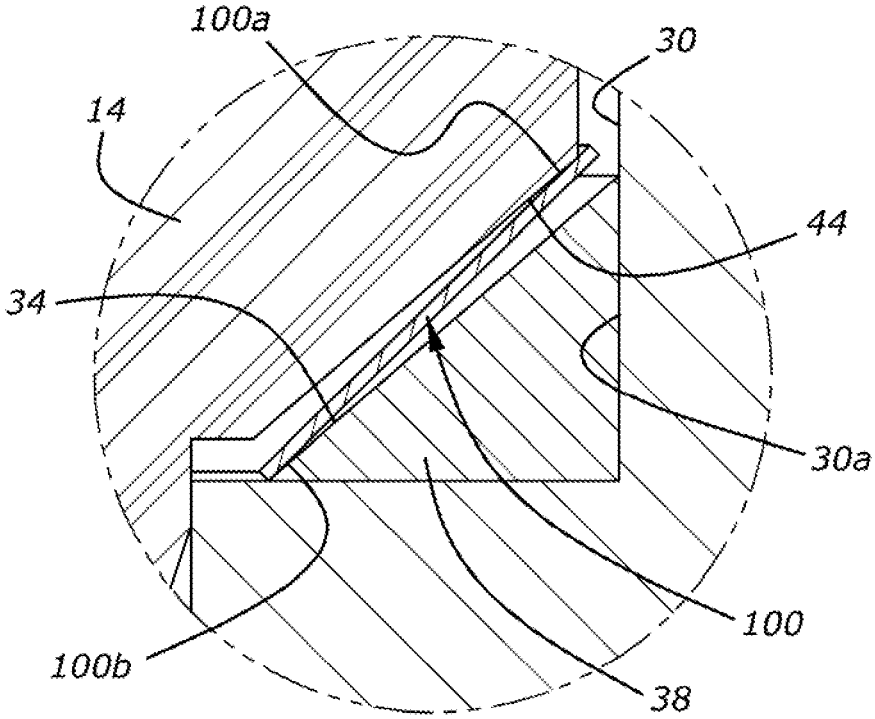
FIG. 12 shows a reversed conicity isolator in an elastic state corresponding to lower load operation.
Figure 13:
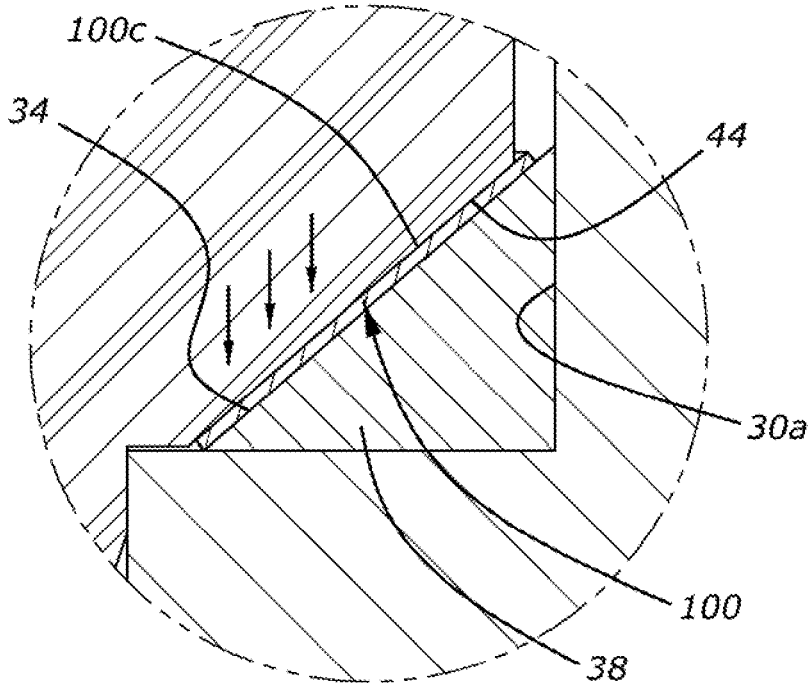
FIG. 13 shows the isolator of FIG. 12 in a compressed state corresponding to higher load operation.

FIGS. 12 and 13 show a reverse conicity isolator, 100 mounted between surface 44 of injector 10 and headliner 52, as supported by conical lower wall 50. Isolator 100 is said to have reverse conicity because its conical structure opens downwardly. Said another way, isolator 100 has an included conic angle which is less than the included conic angles corresponding to the conicity of said conical mounting surface 44 of injector 10/14 and conical lower wall 34 of the injector pocket. The first and second conic angles corresponding to surface 44 and lower wall 34 are preferably generally equal.

As before, the portion of conical ring 100 extending between upper contact portion 100*a* and lower contact portion 100*bd* is displaced radially outward by injector 10 and clamped solidly between conical mounting surface 44 and conical lower wall 50 of injector pocket 30, but only during higher load operation; at idle and other lower load operation, isolator 100 acts as a spring suspension to prevent the ticking noise discussed above.

The foregoing system has been described in accordance with the relevant legal standards, thus the description is exemplary rather than limiting in nature. Variations and modifications to the disclosed embodiments may become apparent to those skilled in the art and fall within the scope of the disclosure. Accordingly, the scope of legal protection can only be determined by studying the following claims.

What is claimed is:

1. A fuel injection system for an internal combustion engine, comprising:

a cylinder head;

an injector pocket extending through the cylinder head to a combustion chamber, with said pocket having a conical lower wall;

a fuel injector mounted within said injector pocket and extending to said combustion chamber, with said injector having a conical mounting surface for engaging the conical lower wall of said injector pocket; and an isolator mounted between the conical mounting surface of said injector and said lower wall of said injector pocket, with said isolator comprising a conical ring having an outer surface; and an inner surface, with said isolator being configured so that:

at lower injection loads, only an upper contact portion of said outer surface of the conical ring contacts said conical lower wall of said injector pocket;

at lower injection loads, only a lower contact portion of said inner surface of the conical ring contacts said conical mounting surface of said injector; and at higher injection loads, the portion of the conical ring extending between the upper contact portion and the lower contact portion is clamped between the conical mounting surface of the injector and the conical lower wall of the injector pocket.

2. The fuel injection system according to claim 1, wherein said isolator comprises a conical ring having an included conic angle which is greater than the included conic angles corresponding to the conicity of said conical mounting surface of said injector and said conical lower wall of said injector pocket.

3. The fuel injection system according to claim 2, wherein said isolator further comprises an annular plate extending from a lower portion of said conical ring, with said annular plate and said conical ring being one piece.

4. The fuel injection system according to claim 1, wherein substantially the entire portion of the conical ring extending between the upper contact portion and the lower contact portion is clamped solidly between the conical mounting surface of the injector and the conical lower wall of the injector pocket during operation of the injector at higher loads, whereby axial movement of the injector will be restricted at higher injector loads.

5. The fuel injection system according to claim 1, wherein said conical ring has a single spring rate which is oriented radially.

6. The fuel injection system according to claim 1, wherein the conical lower wall of the injector pocket is incorporated within a base ring inserted into said cylinder head.

7. The fuel injection system according to claim 1, wherein the conical lower wall of the injector pocket is incorporated within parent metal of said cylinder head.

8. The fuel injection system according to claim 1, wherein said isolator is loaded in bending elastically during operation of the injector at idle and clamped solidly between the conical mounting surface of the injector and the conical lower wall of the injector pocket at higher injection loads.

9. The fuel injection system according to claim 1, wherein said isolator reacts elastically to axial loading during operation of the injector at idle and stacks solidly between the conical mounting surface of the injector and the conical lower wall of the injector pocket at higher injection loads.

10. The fuel injection system according to claim 1, further comprising a head liner interposed between said isolator and said conical lower wall of said injector pocket.

11. The fuel injection system according to claim 1, wherein said isolator comprises a steel structure.

12. An internal combustion engine, comprising:

a cylinder block;

a crankshaft housed within the cylinder block;

a piston and connecting rod mounted upon said crankshaft for reciprocation within said cylinder block;

a cylinder head mounted to said cylinder block;

an injector pocket extending through the cylinder head to a combustion chamber, with said pocket having a conical lower wall;

a fuel injector mounted within said injector pocket and extending to said combustion chamber, with said injector having a conical mounting surface for engaging the conical lower wall of said injector pocket; and a conical ring isolator mounted between the conical mounting surface of said injector and said lower wall of said injector pocket, with said isolator providing spring mounting of the injector at lower injection loads and solid mounting of the injector at higher injection loads, with said isolator comprising a conical ring having an outer surface, and an inner surface, with said isolator being configured so that:

at lower injection loads, only an upper contact portion of said outer surface of the conical ring contacts said conical lower wall of said injector pocket;

at lower injection loads, only a lower contact portion of said inner surface of the conical ring contacts said conical mounting surface of said injector; and at higher injection loads, the portion of the conical ring extending between the upper contact portion and the lower contact portion is displaced radially outward by the injector and clamped solidly between the conical mounting surface of the injector and the conical lower wall of the injector pocket, whereby the injector will be stacked solid with the isolator and the cylinder, thereby restricting axial movement of the injector relative to the cylinder head.

13. The fuel injection system according to claim 12, wherein said isolator comprises a single spring rate conical metallic ring having an included conic angle which is greater than the included conic angles corresponding to the conicity of said conical mounting surface of said injector and said conical lower wall of said injector pocket.

14. An internal combustion engine, comprising:

a cylinder block;

a crankshaft housed within the cylinder block;

a piston and connecting rod mounted upon said crankshaft for reciprocation within said cylinder block;

a cylinder head mounted to said cylinder block;

an injector pocket extending through the cylinder head to a combustion chamber, with said pocket having a conical lower wall with a first angle of conicity;

a fuel injector mounted within said injector pocket and extending to said combustion chamber, with said injector having a conical mounting surface with a second angle of conicity for engaging the conical lower wall of said injector pocket; and a conical ring isolator having a third angle of conicity different from said first angle of conicity and said second angle of conicity, with said conical ring mounted between the conical mounting surface of said injector and said lower wall of said injector pocket, with said isolator providing spring mounting of the injector at lower injection loads and solid mounting of the injector at higher injection loads, with said isolator being configured so that:

at lower injection loads, only upper and lower contact portions the conical ring contact said conical lower wall of said injector pocket and said conical mounting surface of said injector; and at higher injection loads, the portion of the conical ring extending between the upper contact portion and the lower contact portion is displaced radially outward by the injector and clamped solidly between the conical mounting surface of the injector and the conical lower wall of the injector pocket, whereby axial movement of the injector will be restricted.

15. The fuel injection system according to claim 14, wherein said isolator comprises a conical ring having an included conic angle which is greater than the included conic angles corresponding to the conicity of said conical mounting surface of said injector and said conical lower wall of said injector pocket.

16. The fuel injection system according to claim 14, wherein said isolator comprises a conical ring having an included conic angle which is less than the included conic angles corresponding to the conicity of said conical mounting surface of said injector and said conical lower wall of said injector pocket.

17. The fuel injection system according to claim 14, wherein said isolator comprises a conical ring having a third angle of conicity which is less than the first angle of conicity and the second angle of conicity.

18. The fuel injection system according to claim 14, wherein said isolator comprises a conical ring having a third angle of conicity which is greater than the first angle of conicity and the second angle of conicity.

19. The fuel injection system according to claim 14, wherein said first angle of conicity and said second angle of conicity are generally equal.

20. The fuel injection system according to claim 1, wherein said isolator comprises a steel ring structure.

* * * * *